US009466474B2

(12) United States Patent
Ueda

(10) Patent No.: US 9,466,474 B2
(45) Date of Patent: Oct. 11, 2016

(54) TRIPLE QUADRUPOLE MASS SPECTROMETER

(71) Applicant: SHIMADZU CORPORATION, Kyoto-shi, Kyoto (JP)

(72) Inventor: Manabu Ueda, Kyotanabe (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/909,764

(22) PCT Filed: Aug. 8, 2013

(86) PCT No.: PCT/JP2013/071466

§ 371 (c)(1),
(2) Date: Feb. 3, 2016

(87) PCT Pub. No.: WO2015/019461

PCT Pub. Date: Feb. 12, 2015

(65) Prior Publication Data

US 2016/0189949 A1 Jun. 30, 2016

(51) Int. Cl.

| | |
|---|---|
| ***H01J 49/26*** | (2006.01) |
| ***H01J 49/42*** | (2006.01) |
| ***H01J 49/06*** | (2006.01) |
| ***H01J 49/00*** | (2006.01) |

(52) U.S. Cl.
CPC ..... *H01J 49/4215* (2013.01); *H01J 49/005* (2013.01); *H01J 49/06* (2013.01)

(58) Field of Classification Search
USPC ..... 250/281, 282, 283, 288; 702/22, 27, 28
See application file for complete search history.

(56) References Cited

U.S. PATENT DOCUMENTS

2006/0226355 A1* 10/2006 Watanabe ..... H01J 41/10 250/294
2007/0158546 A1 7/2007 Lock et al.
2010/0301227 A1* 12/2010 Muntean ..... H01J 49/421 250/396 R (Continued)

FOREIGN PATENT DOCUMENTS

WO 2010/089798 A1 8/2010
WO 2011/106768 A1 9/2011

OTHER PUBLICATIONS

Written Opinion for PCT/JP2013/071466 dated Sep. 17, 2013. [PCT/ISA/237].

(Continued)

*Primary Examiner* — Nicole Ippolito
(74) *Attorney, Agent, or Firm* — Sughrue Mion, PLLC

(57) ABSTRACT

The present triple quadrupole mass spectrometer determines the relationship between a parameter, such as the mass-to-charge ratio of a precursor ion or that of a product ion, and the optimal collision-gas pressure giving the highest signal intensity in an MRM measurement, derives an approximate equation expressing that relationship, and stores the information representing the equation in an optimum collision-gas pressure calculation information storage section. When a measurement is to be performed, an analysis operator enters the mass-to-charge ratio of a precursor ion or product ion of a target compound. Based on the approximate equation read from the storage section, an optimum collision-gas pressure calculator determines the optimum collision-gas pressure for the specified precursor ion or product ion, and sets this pressure as a measurement condition for the apparatus.

6 Claims, 10 Drawing Sheets

(56) References Cited

U.S. PATENT DOCUMENTS

| | | | | |
|---|---|---|---|---|
| 2011/0183431 | A1* | 7/2011 | Covey | G01N 27/624 436/173 |
| 2013/0105684 | A1* | 5/2013 | Louette | B82Y 15/00 250/282 |

OTHER PUBLICATIONS

International Search Report for PCT/JP2013/071466 dated Sep. 17, 2013. [PCT/ISA/210].

Communication dated Jul. 12, 2016 from the European Patent Office in counterpart Application No. 13890967.6.

* cited by examiner

TRIPLE QUADRUPOLE MASS SPECTROMETER

CROSS REFERENCE TO RELATED APPLICATIONS

This application is a National Stage of International Application No. PCT/JP2013/071466 filed Aug. 8, 2013, the contents of all of which is incorporated herein by reference in its entirety.

TECHNICAL FIELD

The present invention relates to a triple quadrupole mass spectrometer for dissociating an ion having a specific mass-to-charge ratio m/z by collision-induced dissociation and for performing a mass spectrometry of the thereby produced product ions (fragment ions).

BACKGROUND ART

An MS/MS analysis (also called the "tandem analysis"), which is one of the mass spectrometric techniques, has been widely used in recent years, mainly for the purpose of identifying substances having high molecular weights and analyzing their structures. A triple quadrupole mass spectrometer (also called the "tandem quadrupole mass spectrometer" or otherwise) is one type of mass spectrometer capable of MS/MS analyses and is popularly used since it has a comparatively simple structure and is inexpensive.

A triple quadrupole mass spectrometer normally has a collision cell for dissociating an ion by collision-induced dissociation, which is placed between the two quadrupole mass filters provided on the front and rear sides of the cell, respectively. The front quadrupole mass filter selects a precursor ion having a specific mass-to-charge ratio from among various ions derived from a target compound, while the rear quadrupole mass filter separates various product ions produced from the precursor ion according to their mass-to-charge ratios. The collision cell is a box-like structure which is hermetically sealed to a comparatively high degree, into which an inert gas (such as argon or nitrogen) is introduced as the collision gas. The precursor ion selected by the front quadrupole mass filter is given an appropriate amount of collision energy and introduced into the collision cell. Within this collision cell, the ion collides with the collision gas and undergoes the collision-induced dissociation process, whereby the product ions are produced.

The dissociation efficiency of the ion within the collision cell depends on the amount of collision energy possessed by the ion introduced into the collision cell, the pressure of the collision gas in the collision cell (hereinafter, the "collision-gas pressure" should mean "the pressure of the collision gas in the collision cell" unless otherwise specified), and other factors. Therefore, the detection sensitivity of the product ion which has passed through the rear quadrupole mass filter also depends on the amount of collision energy and the collision-gas pressure.

The measurement using a triple quadrupole mass spectrometer is often performed in a multiple reaction monitoring (MRM) mode in which the mass-to-charge ratio at which the ions are allowed to pass through is fixed in each of the front and rear quadrupole mass filters in order to determine, with a high level of accuracy and sensitivity, the quantity of a known compound. Therefore, the collision-gas pressure in a triple quadrupole mass filter is normally designed to be set at a value (usually, a few mTorr) previously adjusted by the manufacturer so that the highest possible level of detection sensitivity will be obtained in the MRM measurement mode. However, the collision-gas pressure which gives the high level of detection sensitivity varies depending on the kind of compound. Therefore, under the condition that the collision-gas pressure is always adjusted at one value in the previously described manner, although the high level of detection sensitivity is obtained for some compounds, the level of detection sensitivity for other compounds will inevitably be low.

To overcome this problem, some triple quadrupole mass spectrometers have the function of allowing analysis operators (users) to freely adjust the collision-gas pressure (see Patent Literature 1). In this type of apparatus, to realize a high level of detection sensitivity for a specific compound, the analysis operators themselves need to investigate the optimum collision gas for that compound. A typical procedure for determining the optimum collision-gas pressure in a conventional triple quadrupole mass spectrometer is as follows:

Initially, the analysis operator prepares a plurality of method files for different levels of collision-gas pressure (a method file is a program file which defines the analysis conditions including the collision-gas pressure, the voltage applied to each component of the apparatus and other parameters). Subsequently, the operator repeatedly performs a preliminary measurement for a sample containing the target compound, using each of the method files, to collect signal intensity data for an ion derived from the target compound, i.e. a set of data which show a change in the signal intensity for a change in the collision-gas pressure. Based on the measurement result, the operator locates the collision-gas pressure which gives the highest signal intensity, and determines that this gas pressure is the optimum collision-gas pressure for that compound.

CITATION LIST

Patent Literature

Patent Literature 1: WO 2010/089798 A

SUMMARY OF INVENTION

Technical Problem

By following the previously described procedure, the optimum collision-gas pressure for the target compound can be assuredly determined. However, the task of repeating the preliminary measurement for a sample containing the same compound significantly consumes the time and labor of the analysis operator as well as lowers the throughput of the analysis. Furthermore, if the sample amount is limited, the number of repetitions of the preliminary measurement needs to be decreased, which increases the probability of failing to find the collision-gas pressure that gives the highest level of detection sensitivity. Additionally, as in the case of a high-concentration sample or a sample of biological origin, if the sample is of a kind that is likely to contaminate a device (e.g. an ion source), repeating the preliminary measurement multiple times may possibly worsen the state of contamination of that device.

The present invention has been developed to solve the previously described problems resulting from the preliminary measurement performed to search for the optimum collision-gas pressure. Its objective is to provide a triple quadrupole mass spectrometer capable of determining the optimum collision-gas pressure for each compound without performing the preliminary measurement.

Solution to Problem

The present inventor has paid attention to the relationships between the optimum collision-gas pressure which gives the highest signal intensity and each of the following parameters: the mass-to-charge ratio of the precursor ion to be monitored, the mass-to-charge ratio of the product ion, the sum (added value) of the mass-to-charge ratio of the precursor ion and that of the product ion, as well as the collision energy, and conducted a close, experimental study on these relationships. Consequently, it has been found that each of the relationships can be approximated by a straight line, a comparatively simple curve or similar form. The present invention has been developed on the basis of this finding and provides a technique for determining the optimum collision-gas pressure for a target compound by a computational process based on known information without performing the preliminary measurement which has conventionally been almost indispensable for determining the optimum collision-gas pressure.

Thus, the first aspect of the present invention developed for solving the previously described problem provides a triple quadrupole mass spectrometer having: a front quadrupole mass filter for selecting, as a precursor ion, an ion having a specific mass-to-charge ratio from among various ions; a collision cell for dissociating the precursor ion by making this ion collide with a predetermined collision gas; a rear quadrupole mass filter for selecting an ion having a specific mass-to-charge ratio from among various product ions produced by the dissociation; and a detector for detecting the selected product ion, the triple quadrupole mass spectrometer including:

a) a prior information storage section in which information showing a relationship between an optimum collision-gas pressure giving the highest or nearly highest level of detection sensitivity and at least one parameter is previously stored, the one parameter selected from the group consisting of the mass-to-charge ratio of the precursor ion, the mass-to-charge ratio of the product ion, the sum of the mass-to-charge ratio of the precursor ion and the mass-to-charge ratio of the product ion, as well as the collision energy; and b) an optimum gas pressure calculator for calculating, based on the information stored in the prior information storage section, the optimum collision-gas pressure corresponding to a measurement condition when at least one of the following parameters is set as the measurement condition: the mass-to-charge ratio of the precursor ion originating from a compound to be analyzed, the mass-to-charge ratio of the product ion, and the collision energy in the measurement.

For example, the information stored in the prior information storage section showing the relationship between the optimum collision-gas pressure giving the highest or nearly highest level of detection sensitivity and at least one parameter selected from the group consisting of the mass-to-charge ratio of the precursor ion, the mass-to-charge ratio of the product ion, the sum of the mass-to-charge ratio of the precursor ion and the mass-to-charge ratio of the product ion, as well as the collision energy, is an approximate equation or a table showing the correspondence relationship of representative points. In the latter case, the points between the neighboring representative points can be determined by an appropriate interpolation or extrapolation.

According to the study by the present inventor, the relationship between the optimum collision-gas pressure giving the highest or nearly highest level of detection sensitivity and each of the four parameters of the mass-to-charge ratio of the precursor ion, the mass-to-charge ratio of the product ion, the sum of the mass-to-charge ratio of the precursor ion and the mass-to-charge ratio of the product ion, as well as the collision energy, is as follows:

(1) The optimum collision-gas pressure increases with an increase in the mass-to-charge ratio of the precursor ion.

(2) The optimum collision-gas pressure increases with an increase in the mass-to-charge ratio of the product ion.

(3) The optimum collision-gas pressure increases with an increase in the sum of the mass-to-charge ratio of the precursor ion and that of the product ion.

(4) The optimum collision-gas pressure increases with an increase in the amount of collision energy.

An increase in the collision-gas pressure causes an increase in the number of collision-gas molecules per unit volume, which normally increases the chance of the collision of the precursor ion with the collusion-gas molecules. An increase in the amount of collision energy means a greater amount of energy which the precursor ion receives when it collides with the collision-gas molecules. Both of these operations constitute a factor for promoting the dissociation of the ion. Meanwhile, a compound having a higher molecular weight normally has a greater number of interatomic bonds inside the molecule, so that a lower amount of energy will be distributed to each interatomic bond. Therefore, a greater amount of total energy is needed to cause the collision-induced dissociation. This is most likely to be the cause of the previously mentioned phenomena (1)-(4).

Each of the relationships (1)-(4) can be represented by an approximate equation or a table showing the correspondence relationship of the representative points. Therefore, for example, the manufacturer of the apparatus can experimentally determine such approximate equations (or other forms of information) and stores the information in the prior information storage section. In an actual analysis using this apparatus, the analysis operator sets the measurement condition including the mass-to-charge ratio of the precursor ion originating from a compound to be analyzed, the mass-to-charge ratio of the product ion, the collision energy in the measurement, and/or other information, using, for example, an input unit. The apparatus may also be configured so that it requires the analysis operator to only specify the compound to be analyzed, and then automatically sets the mass-to-charge ratios, the collision energy and other items of information previously related to the specified compound.

After the measurement conditions including the mass-to-charge ratio of the precursor ion, the mass-to-charge ratio of the product ion and other information are set, the optimum gas pressure calculator computes the optimum collision-gas pressure for the set measurement conditions, based on the approximate equations and/or other information stored in the prior information storage section. For example, the calculated result may be automatically set in the method file as the condition to be used in the measurement, or be displayed on the screen of a display unit to inform the analysis operator of the result. Thus, the triple quadrupole mass spectrometer according to the present invention can determine the collision-gas pressure suitable for detecting the target compound with a high level of sensitivity, without requiring analysis operators to manually perform a preliminary experiment or similar task.

As described earlier, there is a relationship having a characteristic tendency between the optimum collision-gas pressure and each of the four parameters of the mass-to-charge ratio of the precursor ion, the mass-to-charge ratio of the product ion, the sum of the mass-to-charge ratio of the precursor ion and that of the product ion, as well as the collision energy. However, those relationships are nothing more than experimentally obtained ones and may possibly contain a considerable amount of approximation error. To reduce this approximation error, the optimum collision-gas pressure should preferably be determined using a combination of the relationships between the optimum collision-gas pressure and two or more parameters, not one relationship between the optimum collision-gas pressure and a single parameter.

Thus, the triple quadrupole mass spectrometer according to the present invention may preferably be configured so that:

two or more kinds of information each of which shows a relationship between the optimum collision-gas pressure and one of two or more parameters are previously stored in the prior information storage section, the two or more parameters selected from the group consisting of the mass-to-charge ratio of the precursor ion, the mass-to-charge ratio of the product ion, the sum of the mass-to-charge ratio of the precursor ion and the mass-to-charge ratio of the product ion, as well as the collision energy; and the optimum gas pressure calculator is configured to calculate, using a combination of the two or more kinds of information stored in the prior information storage section, the optimum collision-gas pressure corresponding to the measurement condition when at least two parameters selected from the group consisting of the mass-to-charge ratio of the precursor ion corresponding to the compound to be analyzed, the mass-to-charge ratio of the product ion, and the collision energy are set as the measurement condition.

In the case of performing an MRM measurement of a compound, the optimum collision energy normally needs to be previously determined by analysis operators by performing a preliminary experiment. This consumes as much time and labor as the task of determining the optimum collision-gas pressure.

Accordingly, in a preferable mode of the triple quadrupole mass spectrometer according to the present invention:

the information previously stored in the prior information storage section includes a first set of information showing a relationship between the optimum collision-gas pressure and at least one parameter selected from the group consisting of the mass-to-charge ratio of the precursor ion, the mass-to-charge ratio of the product ion, as well as the sum of the mass-to-charge ratio of the precursor ion and the mass-to-charge ratio of the product ion, and a second set of information showing a relationship between the collision energy and the optimum collision-gas pressure; and the optimum gas pressure calculator is configured to initially calculate the optimum collision-gas pressure corresponding to the measurement condition, based on the first set of information stored in the prior information storage section, when the mass-to-charge ratio of the precursor ion to be analyzed and/or the mass-to-charge ratio of the product ion is set in the measurement condition, and to subsequently calculate the collision energy corresponding to the calculated optimum collision-gas pressure, based on the second set of information stored in the prior information storage section.

By this configuration, both the optimum collision-gas pressure and the optimum collision energy can be simultaneously determined, without requiring the analysis operator to perform a preliminary experiment for determining the optimum collision energy at which the highest or nearly highest level of detection sensitivity can be obtained.

By the way, there are various commonly known factors representing qualitative natures of compounds, such as LogP and LogS. In general, measuring such a factor requires a cumbersome method. LogP is a distribution coefficient between water and 1-octanol. This factor is used for evaluating the lipid solubility of compounds. A greater LogP value represents a higher degree of lipid solubility. Currently, LogP is widely used as a standard index; for example, it has been adopted as an evaluation item in a legal regulation of chemical substances. LogP is also used as one of the indices representing the ease of permeation through biological membranes and is recognized as an extremely important value in the fields of physiology and drug discovery. LogS is the value obtained by taking the logarithm of the amount of compound soluble in 100 g of water. Similarly to LogP, LogS represents a nature of compounds.

A commonly used method for measuring the LogP value of a compound is as follows: A compound to be analyzed is put in and shaken with water and 1-octanol in equal quantities until the equilibrium is reached. The solubility of the compound in each solvent is measured. After the solubility in water, Cw, and the solubility in octanol, Co, are determined, the degree of solubility of the compound to be analyzed is determined by calculating the logarithm of [Co/Cw]. However, such a measurement method requires dedicated laboratory instruments as well as 1-octanol. Furthermore, the measurement needs a considerable amount of time and includes many cumbersome tasks. On the other hand, measuring the LogS value of a compound requires measuring the solubility of the compound in 100 g of water. Therefore, a considerable amount of sample is needed, and the measurement is difficult to perform if the amount of available sample is insufficient.

In the process of experimentally studying the relationship between the collision-gas pressure and the signal intensity in the triple quadrupole mass spectrometer, the present inventor discovered that the shape of the curve showing the relationship between the collision-gas pressure and the signal intensity is not significantly dependent on hardware factors (e.g. the shape of the collision cell itself or that of the ion guide contained in the collision cell) but is mostly dependent on the nature of the compound. This fact suggests that the LogP, LogS or other indices representing the chemical nature of compounds are significant factors which determine the shape of the curve showing the relationship between the collision-gas pressure and the signal intensity. Based on this finding, the present inventor has developed the second aspect of the present invention for solving the previously described problem.

Thus, the triple quadrupole mass spectrometer according to the second aspect of the present invention developed for solving the previously described problem is a triple quadrupole mass spectrometer having: a front quadrupole mass filter for selecting, as a precursor ion, an ion having a specific mass-to-charge ratio from among various ions; a collision cell for dissociating the precursor ion by making this ion collide with a predetermined collision gas; a rear quadrupole mass filter for selecting an ion having a specific mass-to-charge ratio from among various product ions produced by the dissociation; and a detector for detecting the selected product ion, the triple quadrupole mass spectrometer including:

a) an analysis controller for controlling each section of the mass spectrometer so as to perform a multiple reaction monitoring measurement on a target compound while continuously or discontinuously varying the pressure of the collision gas within the collision cell;

b) a data processor for obtaining a relationship between the change in the pressure of the collision gas and the change in the signal intensity, based on the detection signal obtained under the control by the analysis controller; and c) a parameter calculator for determining a parameter indicating a physical or chemical nature of the target compound, based on the shape of a curve showing the relationship between the change in the pressure of the collision gas and the change in the signal intensity.

The compound information estimator may be configured to determine LogP, LogS, LogS-LogP, polarizability or refractivity of the target compound.

Since the shape of the curve showing the relationship between the collision-gas pressure and the signal intensity reflects the aforementioned kind of physical or chemical nature of the target compound, it is possible to identify the compound from the shape of this curve. Thus, the third aspect of the present invention provides a triple quadrupole mass spectrometer having: a front quadrupole mass filter for selecting, as a precursor ion, an ion having a specific mass-to-charge ratio from among various ions; a collision cell for dissociating the precursor ion by making this ion collide with a predetermined collision gas; a rear quadrupole mass filter for selecting an ion having a specific mass-to-charge ratio from among various product ions produced by the dissociation; and a detector for detecting the selected product ion, the triple quadrupole mass spectrometer including:

a) an analysis controller for controlling each section of the mass spectrometer so as to perform a multiple reaction monitoring measurement on a target compound while continuously or discontinuously varying the collision-gas pressure within the collision cell;

b) a data processor for obtaining a relationship between the change in the collision-gas pressure and the change in the signal intensity, based on the detection signal obtained under the control by the analysis controller;

c) a qualitative information storage section in which the shape of a curve showing the relationship between the change in the collision-gas pressure and the change in the signal intensity is stored in relation to the kind of compound; and d) a compound identifier for identifying the target compound by comparing the shape of a curve obtained by the data processor with the information stored in the qualitative information storage section.

Advantageous Effects of the Invention

With the triple quadrupole mass spectrometer according to the first aspect of the present invention, the optimum collision-gas pressure which gives the highest or nearly highest level of detection sensitivity to a product ion originating from a target compound can be determined by calculations, without actually performing a preliminary measurement or similar task on a sample containing that target compound. Since it is unnecessary to prepare a plurality of method files with the collision-gas pressure gradually varied and to perform a preliminary measurement using those method files, the time will be saved and the efficiency of the analysis will be improved. The optimum collision-gas can be assuredly determined even if the amount of the sample is so low that it is difficult to perform the preliminary measurement multiple times to search for the optimum collision-gas pressure. Additionally, the time, labor and cost for the overhaul of a contaminated apparatus can be reduced, since it is unnecessary to repeatedly perform the preliminary measurement of a sample that may possibly contaminate the apparatus as in the case of a high-concentration sample or sample of biological origin.

With the triple quadrupole mass spectrometer according to the second aspect of the present invention, the LogP, LogS and other factors representing the qualitative natures of a target compound can be easily obtained without performing a cumbersome measurement or similar task. The triple quadrupole mass spectrometer according to the third aspect of the present invention enables the easy and convenient identification of a compound.

DESCRIPTION OF EMBODIMENTS

[First Embodiment]

The first embodiment of a liquid chromatograph triple quadrupole mass spectrometer (which is hereinafter abbreviated as the "LC/MS/MS") using a triple quadrupole mass spectrometer according to the present invention is hereinafter described with reference to the attached drawings.

Figure 1:
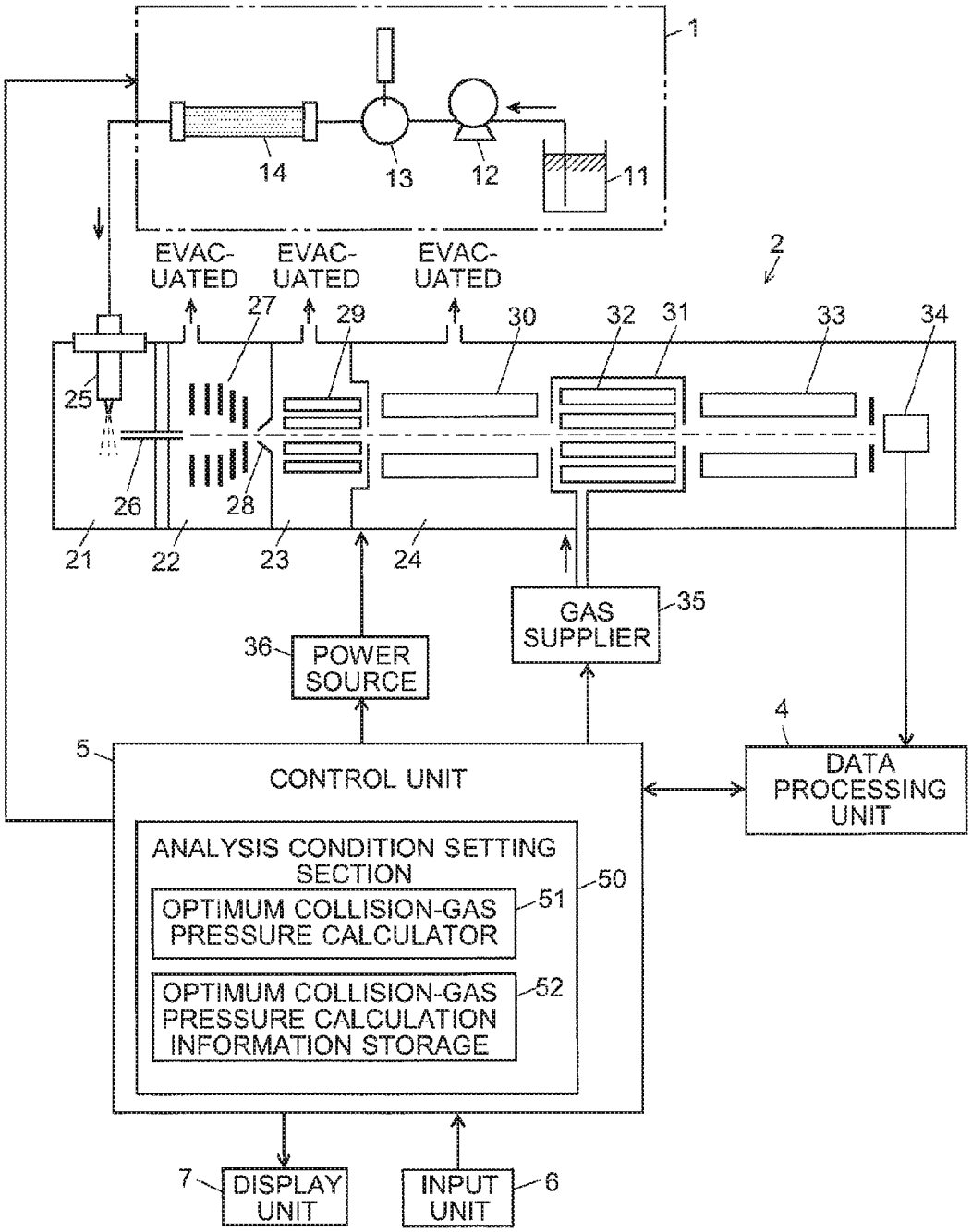
FIG. 1 is a schematic configuration diagram of the main components of the first embodiment of an LC/MS/MS using a triple quadrupole mass spectrometer according to the present invention.

FIG. 1 is a schematic configuration diagram of the main components of the LC/MS/MS of the first embodiment.

In the LC/MS/MS of the first embodiment, the liquid chromatograph unit 1 includes a mobile-phase container 11 holding a mobile phase, a liquid-sending pump 12 for drawing and supplying the mobile phase at a fixed flow rate, an injector 13 for injecting a predetermined amount of prepared sample into the mobile phase, and a column 14 for temporally separating the various compounds contained in the sample. The liquid pump 12 draws the mobile phase from the mobile-phase container 11 and supplies it to the column 14 at a fixed flow rate. When a certain amount of sample liquid is injected from the injector 13 into the mobile phase, the sample is carried by the mobile phase into the column 14. While passing through this column 14, various compounds in the sample are temporally separated and eluted from the exit port of the column 14, to be introduced into the mass spectrometer 2.

The mass spectrometer 2 has the configuration of a multistage differential pumping system having an ionization chamber 21 maintained at substantially atmospheric pressure and an analysis chamber 24 evacuated to a high degree of vacuum by a high-performance vacuum pump (not shown), between which first and second intermediate chambers 22 and 23 are provided having their degrees of vacuum increased in a stepwise manner. The ionization chamber 21 is provided with an electrospray ionization (ESI) probe 25 for spraying a sample solution while giving electric charges to this solution. The ionization chamber 21 communicates with the first intermediate vacuum chamber 22 in the next stage through a thin heated capillary 26. The first and second intermediate chambers 22 and 23 are separated from each other by a skimmer 28 having a small hole at its apex. Ion guides 27 and 29 for transporting ions to the subsequent section while converging them are provided in the first and second intermediate vacuum chambers 22 and 23, respectively.

Within the analysis chamber 24, a collision cell 31 containing a multipole ion guide 32 is provided between front and rear quadrupole mass filters 30 and 33 which separate ions according to their mass-to-charge ratios. Additionally, an ion detector 34 is placed behind the rear quadrupole mass filter 33. A gas supplier 35 supplies collision gas (e.g. argon or nitrogen) to the inside of the collision cell 31. A power source 36 applies predetermined forms of voltage to the ESI probe 25, ion guides 27, 29 and 32, quadruple mass filters 30 and 33, as well as other components, respectively.

In this mass spectrometer 2, when the eluate from the exit port of the column 14 reaches the tip portion of the ESI probe 25, the eluate is sprayed into the ionization chamber 21 while receiving electric charges. The electrically charged droplets produced by the spraying process are divided into smaller sizes by colliding with the ambient air as well as by the Coulomb repulsive force. During this process, the solvent in the droplets vaporizes, and ions derived from the compounds in the droplets are ejected. The thereby produced ions are sent through the heated capillary 26 into the first intermediate vacuum chamber 22, where the ions are converged by the ion guide 27 and sent through the small hole at the apex of the skimmer 28 into the second intermediate vacuum chamber 23. Then, the compound-derived ions are converged by the ion guide 29 and sent into the analysis chamber 24, where they are introduced into the space extending along the longitudinal axis of the front quadrupole mass filter 30. Naturally, the ionization method is not limited to the ESI; other atmospheric pressure ionization methods may also be used, such as the atmospheric pressure chemical ionization (APCI) or atmospheric pressure photoionization (APPI).

In the mass spectrometer 2, when an MS/MS analysis is performed, a predetermined form of voltage (produced by superposing a radio-frequency voltage on a direct-current voltage) is applied from the power source 36 to each of the rod electrodes of the front and rear quadrupole mass filters 30 and 33, while the collision gas is continuously or intermittently supplied from the gas supplier 35 to the inside of the collision cell 31. Among the various ions sent into the front quadrupole mass filter 30, only an ion having a specific mass-to-charge ratio m/z corresponding to the voltage applied to the rod electrodes of the front quadrupole mass filter 30 is allowed to pass through this filter 30 and be introduced the collision cell 31 as the precursor ion.

Within the collision cell 31, the precursor ion collides with the collision gas and becomes dissociated, whereby various product ions are produced. The various product ions produced in this manner are introduced into the rear quadrupole mass filter 33, where only a product ion having a specific mass-to-charge ratio corresponding to the voltage applied to the rod electrodes of the rear quadrupole mass filter 33 is allowed to pass through this filter 33, to eventually arrive at and be detected by the ion detector 34. The ion detector 34 produces a detection signal corresponding to the number of incident ions and sends this signal to a data processing unit 4.

The data processing unit 4 has the function of creating chromatograms and/or mass spectra based on the data produced by digitizing the signal fed from the mass spectrometer 2, as well as the function of performing a qualitative or quantitative determination process based on those chromatograms and/or mass spectra. A control unit 5, which is provided with an input unit 6 and a display unit 7, controls the operations of the liquid-sending pump 12 and the injector 13 in the liquid chromatograph unit 1, the power source 36 and the gas supplier 35 in the mass spectrometer 2, as well as other components in the system according to previously set analysis conditions. The control unit 5 includes an analysis condition setting section 50 as the functional block for determining the analysis conditions in advance of the execution of the analysis. The analysis condition setting section 50 includes an optimal collision-gas pressure calculator 51 and an optimum collision-gas pressure calculation information storage section 52.

At least some of the functions of the control unit 5 and the data processing unit 4 can be realized using a personal computer as hardware resources by running, on this computer, a dedicated controlling and processing software program previously installed on the computer.

The information previously stored in the optimum collision-gas pressure calculation information storage section 52 in the LC/MS/MS of the first embodiment is described.

Figure 2A:
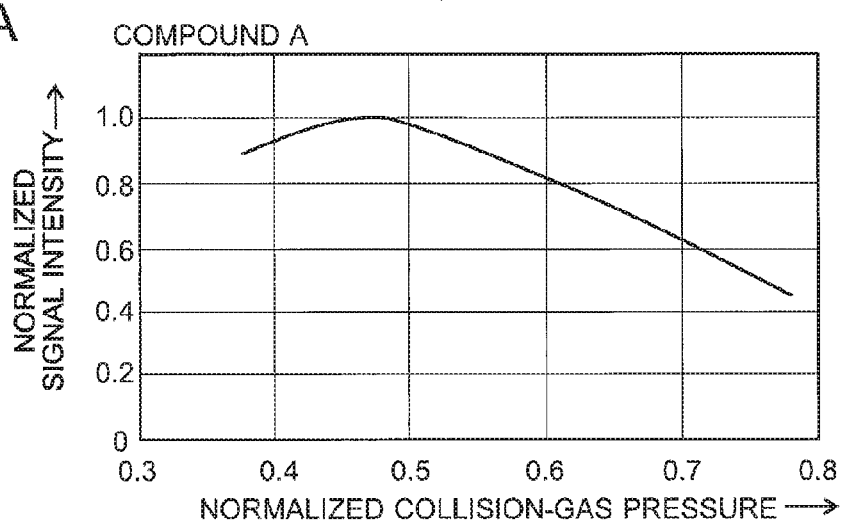
FIGS. 2A-2C show the result of an experiment performed to determine the relationship between the collision-gas pressure and the signal intensity in an MRM measurement performed on three different kinds of compounds.
Figure 2B:
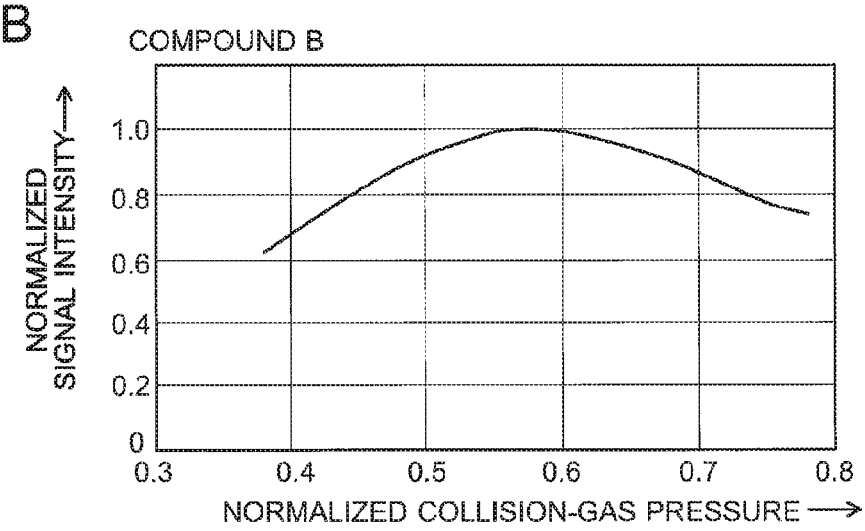
Figure 2C:
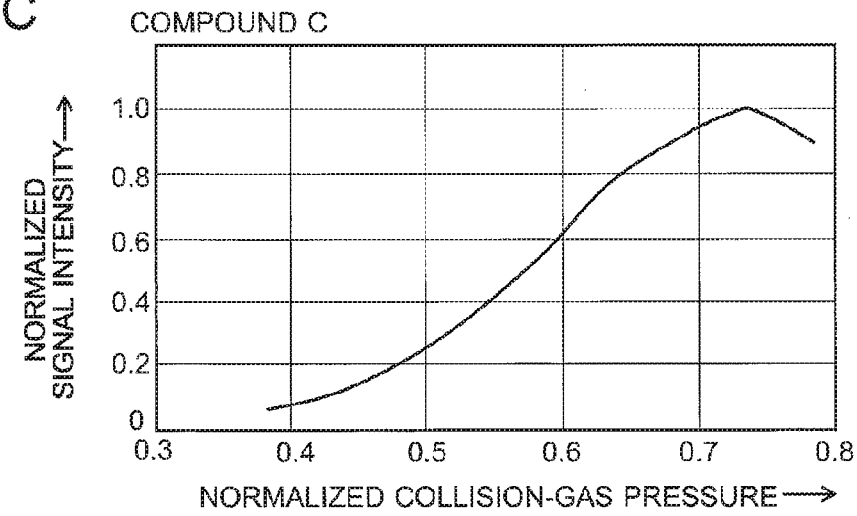

FIGS. 2A-2C are graphs showing the signal intensity obtained by performing an MRM measurement for three different compounds A, B and C with the collision-gas pressure sequentially changed to multiple levels (i.e. the signal intensity of a product ion derived from each compound). Both horizontal and vertical axes indicate normalized values.

Figure 3:
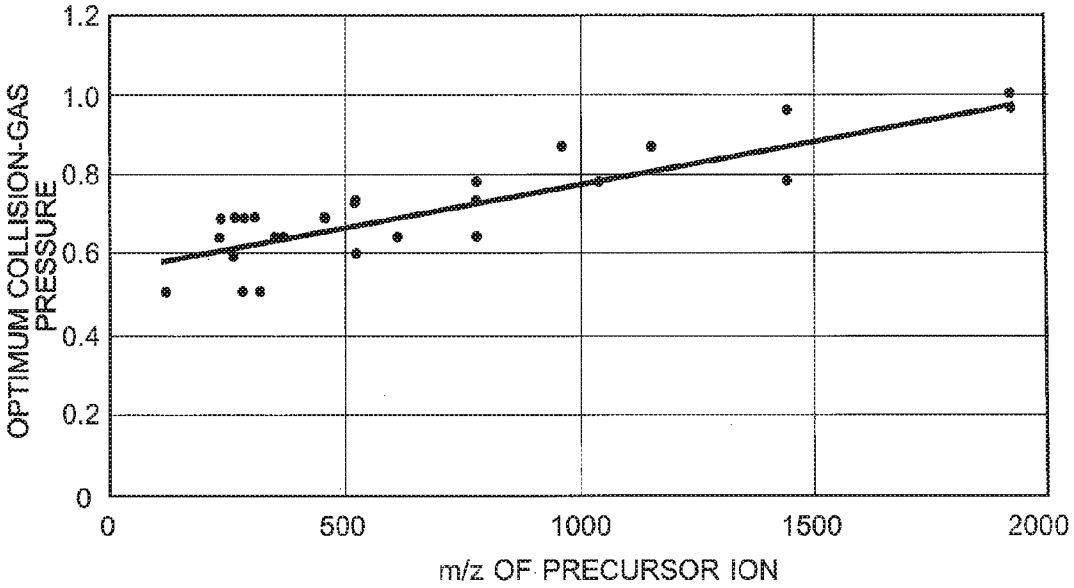
FIG. 3 shows the result of an investigation on the relationship between the mass-to-charge ratio of the precursor ion and the optimum collision-gas pressure for a number of compounds.
Figure 4:
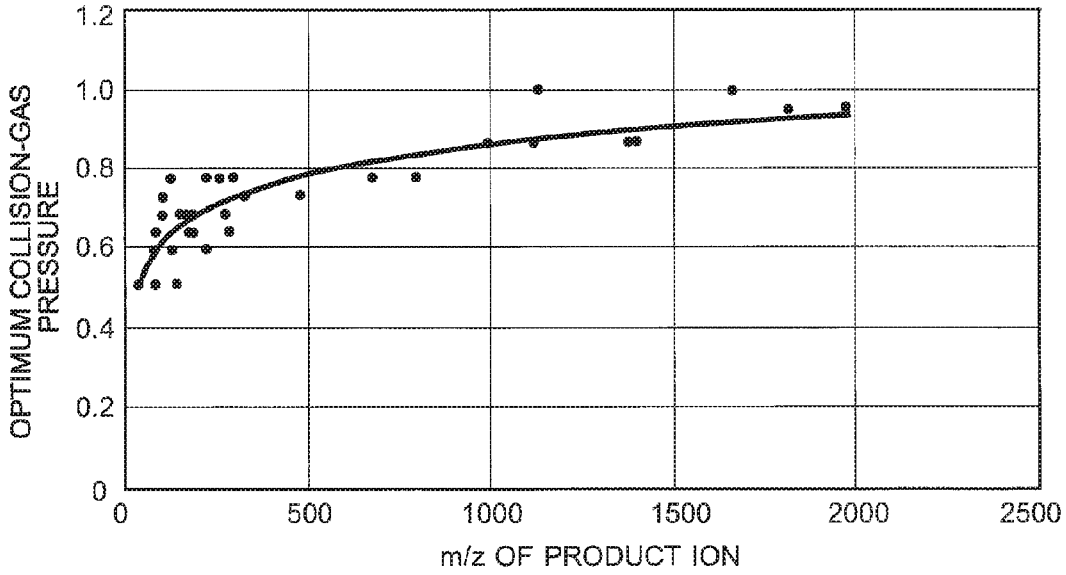
FIG. 4 shows the result of an investigation on the relationship between the mass-to-charge ratio of the product ion and the optimum collision-gas pressure for a number of compounds.
Figure 5:
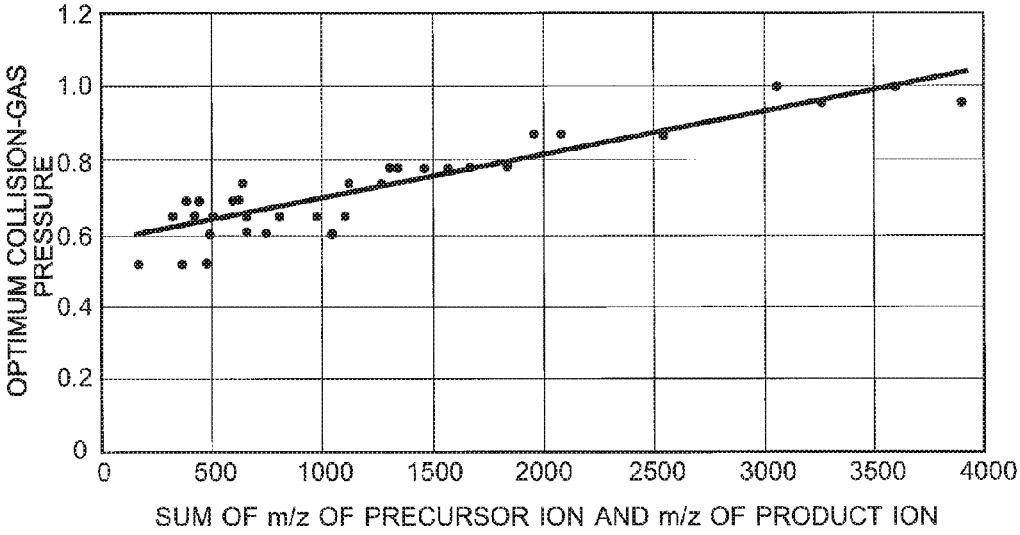
FIG. 5 shows the result of an investigation on the relationship between the sum of the mass-to-charge ratio of the precursor ion and that of the product ion and the optimum collision-gas pressure for a number of compounds.
Figure 6:
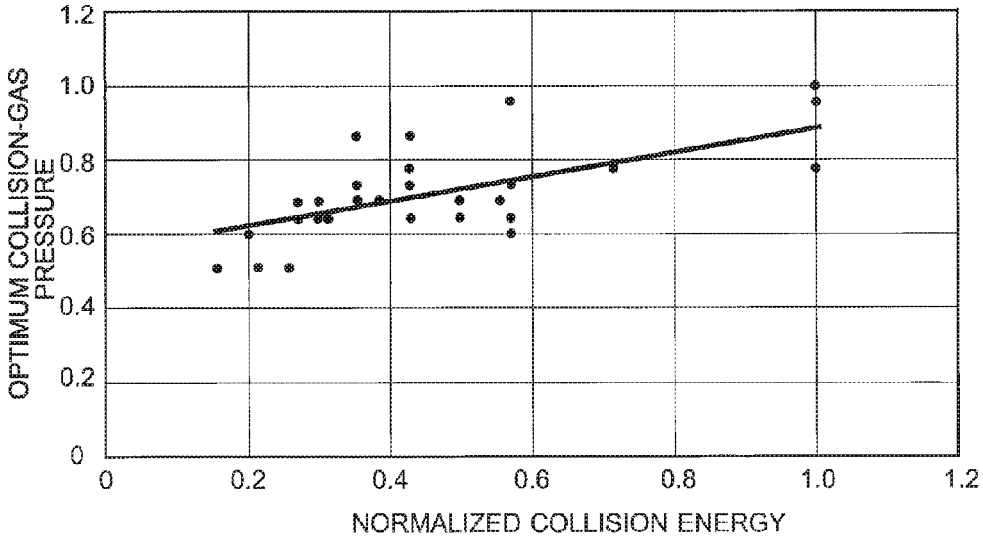
FIG. 6 shows the result of an investigation on the relationship between the collision energy and the optimum collision-gas pressure for a number of compounds.

FIGS. 2A-2C demonstrate that the collision-gas pressure which gives the highest signal intensity, i.e. the optimum collision-gas pressure, varies depending on the kind of compound: 0.47 for compound A, 0.56 for compound B, and 0.73 for compound C. These are the results obtained from only a portion of the entire group of compounds. Actually, a greater number of compounds were subjected to similar measurements. FIGS. 3-5 are the results of the entire investigation, which respectively show: the relationship between the mass-to-charge ratio of the precursor ion and the optimum collision-gas pressure, the relationship between the mass-to-charge ratio of the product ion and the optimum collision-gas pressure, and the relationship between the sum of the mass-to-charge ratio of the precursor ion and that of the product ion and the optimum collision-gas pressure. FIG. 6 shows the result of an investigation on the relationship between the collision energy and the optimum collision-gas pressure, not between the kind of compound and the optimum collision-gas pressure. The collision energy mainly depends on the voltage difference between the direct bias voltage applied to the front quadrupole mass filter 30 placed before the collision cell 31 and the direct bias voltage applied to the collision cell 31.

FIG. 3 demonstrates that the optimum collision-gas pressure increases with an increase in the mass-to-charge ratio of the precursor ion. In the present case, the relationship between the mass-to-charge ratio of the precursor ion and the optimum collision-gas pressure can be roughly approximated by a straight line.

FIG. 4 demonstrates that the optimum collision-gas pressure increases with an increase in the mass-to-charge ratio of the product ion. In the present case, the relationship between the mass-to-charge ratio of the product ion and the optimum collision-gas pressure can be roughly approximated by a logarithmic function.

FIG. 5 demonstrates that the optimum collision-gas pressure increases with an increase in the sum of the mass-to-charge ratio of the precursor ion and that of the product ion. In the present case, the relationship between the sum of the mass-to-charge ratio of the precursor ion and that of the product ion and the optimum collision-gas pressure can be roughly approximated by a straight line.

FIG. 6 demonstrates that the optimum collision-gas pressure increases with an increase in the collision energy. In the present case, the relationship between the collision energy and the optimum collision-gas pressure can be roughly approximated by a straight line.

The reason for the previously described relationships can be inferred as follows: Normally, when the collision-gas pressure is increased, the probability of the collision of the compound-derived ion (precursor ion) with the collision gas becomes higher, which causes a corresponding increase in the amount of energy given to the ion by the collision and makes the dissociation more likely to occur. Similarly, when the collision energy imparted to the precursor ion is increased, the ion is more likely to be dissociated upon colliding with the collision gas. However, a precursor ion having a higher molecular weight normally has a greater number of interatomic bonds inside the molecule, which means a lower amount of energy will be distributed to each interatomic bond if the amount of energy imparted by the collision is the same. From these facts, it can be inferred that a compound having a higher molecular weight requires a higher level of collision-gas pressure or a higher amount of collision energy to promote its dissociation, i.e. to break the interatomic bonds within the molecule.

From the previous discussion, it is possible to understand that the optimum collision-gas pressure has a predetermined relationship with each of the four parameters: the mass-to-charge ratio of the precursor ion, the mass-to-charge ratio of the product ion, the sum of the mass-to-charge ratio of the precursor ion and that of the product ion, as well as the collision energy. By previously determining these relationships, it is possible to approximately calculate the optimum collision-gas pressure by simple computations using those relationships when the mass-to-charge ratio of the precursor ion, the mass-to-charge ratio of the product ion, the sum of the mass-to-charge ratio of the precursor ion and that of the product ion, or the collision energy is given.

Specifically, as shown in FIGS. 3, 5 and 6, the relationship between the optimal collision-gas pressure and each of the parameters of the mass-to-charge ratio of the precursor ion, the sum of the mass-to-charge ratio of the precursor ion and that of the product ion, and the collision energy can be approximated by a straight line, and therefore, the approximate equation can be expressed as a linear expression. In other words, in each case, the approximate expression for computing the optimum collision-gas pressure P can be formed as follows:

$$P=a\cdot X+b$$

where X represents the mass-to-charge ratio Mc of the precursor ion, the sum Mc+Md of the mass-to-charge ratio Mc of the precursor ion and the mass-to-charge ratio Md of the product ion, or the collision energy CE, while a and b are constants. On the other hand, as shown in FIG. 4, the relationship between the mass-to-charge ratio of the product ion and the optimum collision-gas pressure can be approximated by a logarithmic function, and therefore, the approximate equation can be expressed as a logarithmic function. In other words, the approximate expression for computing the optimum collision-gas pressure P can be formed as follows:

$$P=c\cdot\ln(Md)+d$$

where Md is the mass-to-charge ratio of the product ion, while c and d are constants.

For example, the approximate equations for the relationships shown in FIGS. 3-6 can be determined as follows:

The relationship between the mass-to-charge ratio Mc of the precursor ion and the optimum collision-gas pressure P1 is given by the following equation (1):

$$P1=0.0002108\times Mc+0.5611 \quad (1)$$

The relationship between the mass-to-charge ratio Md of the product ion and the optimum collision-gas pressure P2 is given by the following equation (2):

$$P2=0.1116\times\mathrm{Ln}(Md)+0.09296 \quad (2)$$

The relationship between the sum Mc+Md of the mass-to-charge ratio Mc of the precursor ion and the mass-to-charge ratio Md of the product ion and the optimum collision-gas pressure P3 is given by the following equation (3):

$$P3=0.0001184\times(Mc+Md)+0.5750 \quad (3)$$

The relationship between the collision energy CE and the optimum collision-gas pressure P4 is given by the following equation (4):

$$P4=0.3311\times\mathrm{CE}+0.5560 \quad (4)$$

Normally, apparatuses whose basic configuration and structure are identical have negligible individual differences in terms of the relationships expressed by equations (1)-(4).

Accordingly, in the LC/MS/MS of the present embodiment, for example, the manufacturer of the apparatus determines the approximate equations relating to the optimum collision-gas pressure as expressed by equations (1)-(4) based on the results of MRM measurements performed on a number of compounds, and stores information representing those approximate equations in the optimum collision-gas pressure calculation information storage section 52 consisting of a non-volatile ROM or similar device.

When the quantitative determination of a known kind of target compound contained in a sample is to be performed using the LC/MS/MS of the present embodiment, an analysis operator using the input unit 6 enters various parameters necessary for performing the MRM measurement mode (e.g. the mass-to-charge ratio of the precursor ion and that of the product ion to be monitored in the MRM measurement) as one of the measurement conditions. The analysis condition setting section 50 prepares a method file to be used for performing the measurement based on the entered information. In this process, the optimum collision-gas pressure calculator 51 computes the optimum collision-gas pressure for the mass-to-charge ratio of the precursor ion, the mass-to-charge ratio of the product ion and/or other specified information, based on the previously mentioned information stored in the optimum collision-gas pressure calculation information storage section 52.

Specifically, the optimum collision-gas pressure calculator 51 creates approximate equations corresponding to equations (1)-(3) based on the information read from the optimum collision-gas pressure calculation information storage section 52. Using these approximate equations, the calculator computes the value of the optimum collision-gas pressure for each of the specified parameters: the mass-to-charge ratio of the precursor ion, the mass-to-charge ratio of the product ion, as well as the sum of the mass-to-charge ratio of the precursor ion and that of the product ion. The average of the three values of the optimum collision-gas pressure is calculated, and the result is adopted as the optimum value of the collision-gas pressure. If the collision energy is also set as a measurement condition, it is preferable to additionally calculate the value of the optimum collision-gas pressure for the set collision energy using an approximate equation corresponding to equation (4), and include this value in the original data whose average is to be calculated.

If the collision energy is not set as a measurement condition, the optimum collision-gas pressure calculator 51 initially calculates the optimum collision-gas pressure using the approximate equations corresponding to equations (1)-(3) in the previously described manner and subsequently back-calculates the collision energy by substituting the calculated value of the optimum collision-gas pressure into the approximate equation corresponding to equation (4). Thus, the optimum collision energy corresponding to the optimum collision-gas pressure can be determined.

After the value of the optimum collision-gas pressure for the precursor ion and product ion originating from the specified compound, or the values of the optimum collision-gas pressure and the collision energy for those ions are calculated in the previously described way, the analysis condition setting section 50 writes those values in the method file as the collision-gas pressure and the collision energy to be used in the MRM measurement for the target compound.

As one example, the optimum collision-gas pressure for compound C shown in FIG. 2C is calculated on the assumption that the approximate equations for the optimum collision-gas pressure are given by equations (1)-(4).

The mass-to-charge ratio of the precursor ion of compound C is m/z 787.00, the mass-to-charge ratio of the product ion is m/z 333.20, and the collision energy is 0.36. Substituting these values into equations (1)-(4) yields the optimum collision-gas pressures P1, P2, P3 and P4 as follows: P1=0.727, P2=0.741, P3=0.708 and P4=0.675. Averaging these values results in Pav=0.713. This average value Pay is approximately equal to the collision-gas pressure giving the highest signal intensity in FIG. 2C, which means that the calculated average indeed is the optimum collision-gas pressure.

Each of the values P1, P2, P3 and P4 respectively calculated using the approximate equations based on equations (1)-(4) can also be considered as adequately close to the optimum collision-gas pressure in FIG. 2C. Therefore, it is also possible to directly adopt any one of those gas-pressure values P1, P2, P3 and P4 as the optimum collision-gas pressure instead of using the average value Pay. The average of two or more of the gas-pressure values P1, P2, P3 and P4, or the median or similar simple values other than the average can also be used as the optimum collision-gas pressure without causing any practical problem.

Thus, in the LC/MS/MS of the present embodiment, an appropriate level of collision-gas pressure for performing an MRM measurement of a target compound can be set without requiring a preliminary measurement to be performed on the user's side.

The method file prepared in the previously described manner is stored in a storage section (not shown) in the control unit 5. Upon being commanded to initiate the measurement, the control unit 5 conducts an analysis on a sample while controlling the power source 36 and the gas supplier 35 according to the parameters and other information held in the stored method file. Accordingly, when the MRM measurement of the target component is performed, the collision-gas pressure within the collision cell 31 is automatically adjusted so that the detection sensitivity for ions will be at the highest or nearly highest level, and consequently, the product ion originating from the target compound will be detected with a high level of sensitivity.

[Second Embodiment]

The second embodiment of the LC/MS/MS using a triple quadrupole mass spectrometer according to the present invention is described with reference to the attached drawings.

Figure 7:
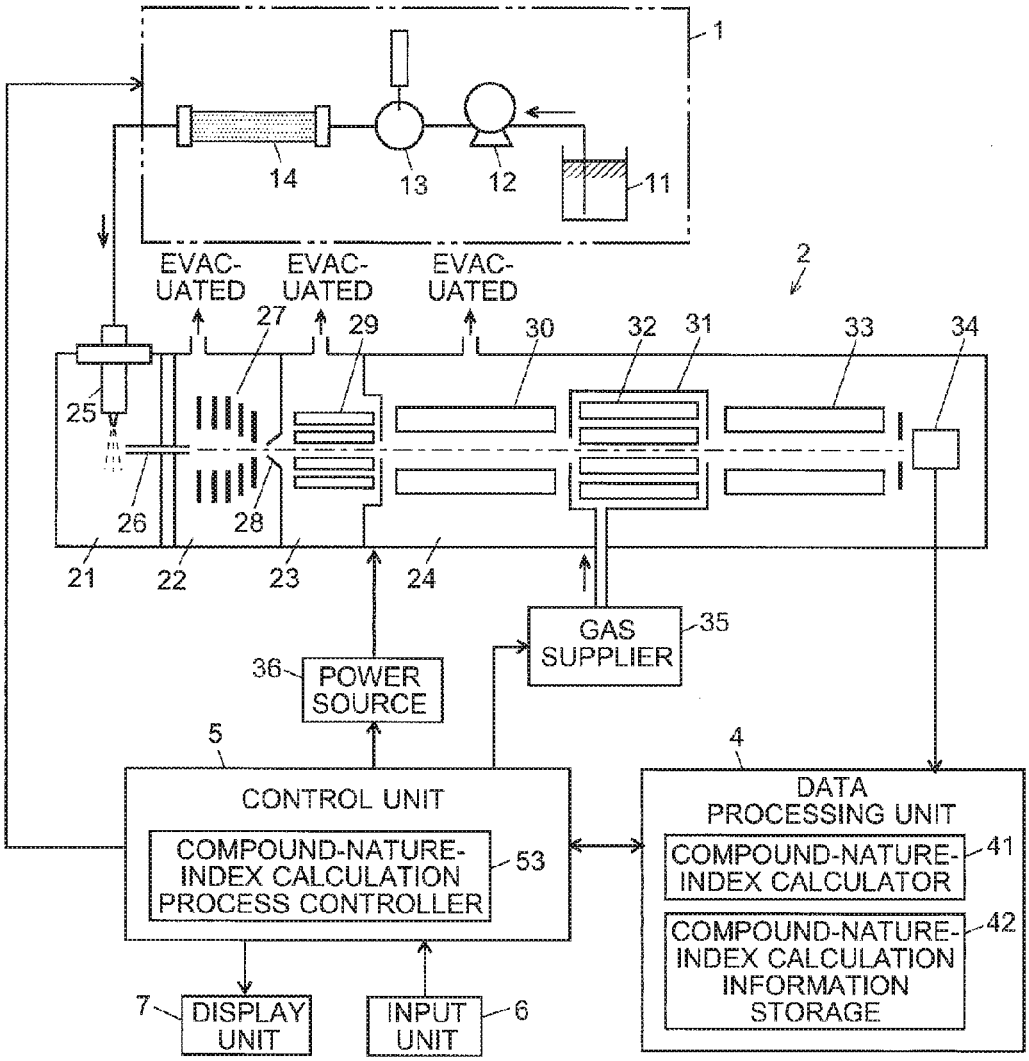
FIG. 7 is a schematic configuration diagram of the main components of the second embodiment of an LC/MS/MS using a triple quadrupole mass spectrometer according to the present invention.

FIG. 7 is a schematic configuration diagram of the main components of the LC/MS/MS as the second embodiment. The configurations of the liquid chromatograph unit 1 and the mass spectrometer 2 are identical to those of the first embodiment, and therefore will not be described. The LC/MS/MS of the second embodiment differs from the first embodiment in that the data processing unit 4 includes a compound-nature-index calculator 41 and a compound-nature-index calculation information storage section 42 as its functional blocks, while the control unit 5 includes a compound-nature-index calculation process controller 53 as its functional block.

As already explained, in an MRM measurement for one compound, a change in the collision-gas pressure causes a corresponding change in the signal intensity. The curves showing the relationship between the collision-gas pressure and the signal intensity in FIGS. 2A-2C do not only demonstrate that the optimum collision-gas pressure changes depending on the kind of compound; they also demonstrate that the overall shape of the curve also changes depending on the kind of compound.

Figure 8A:
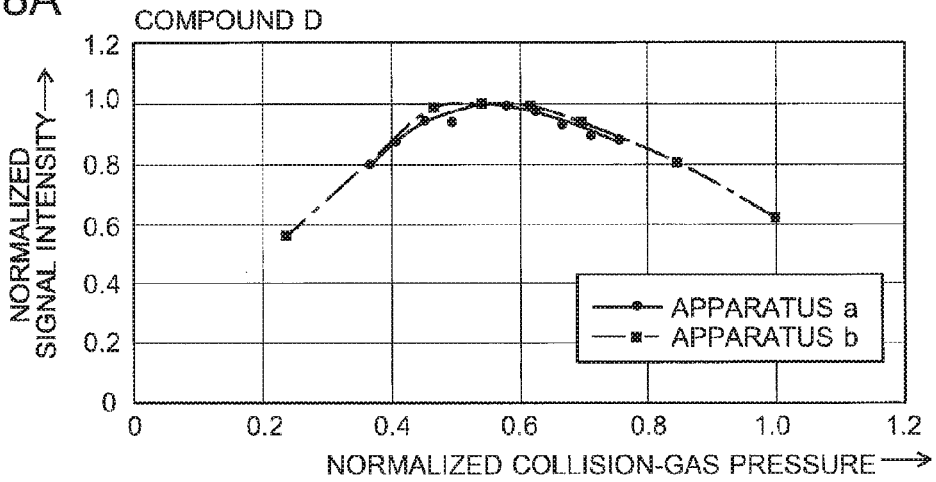
FIGS. 8A-8C show the relationship between the collision-gas pressure and the normalized signal intensity among different apparatuses.
Figure 8B:
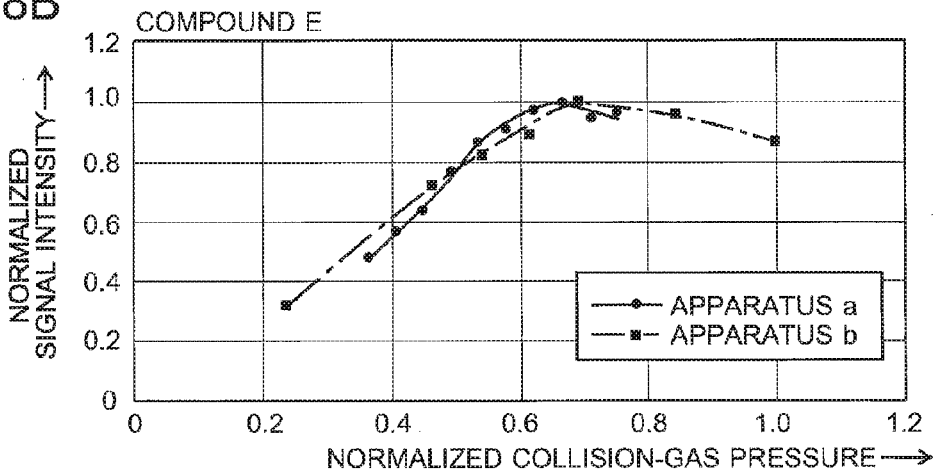
Figure 8C:
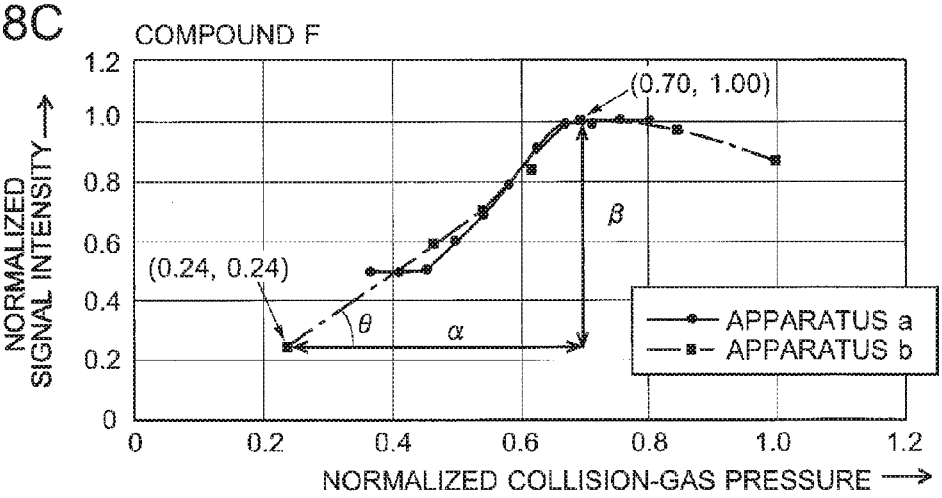
Figure 9:
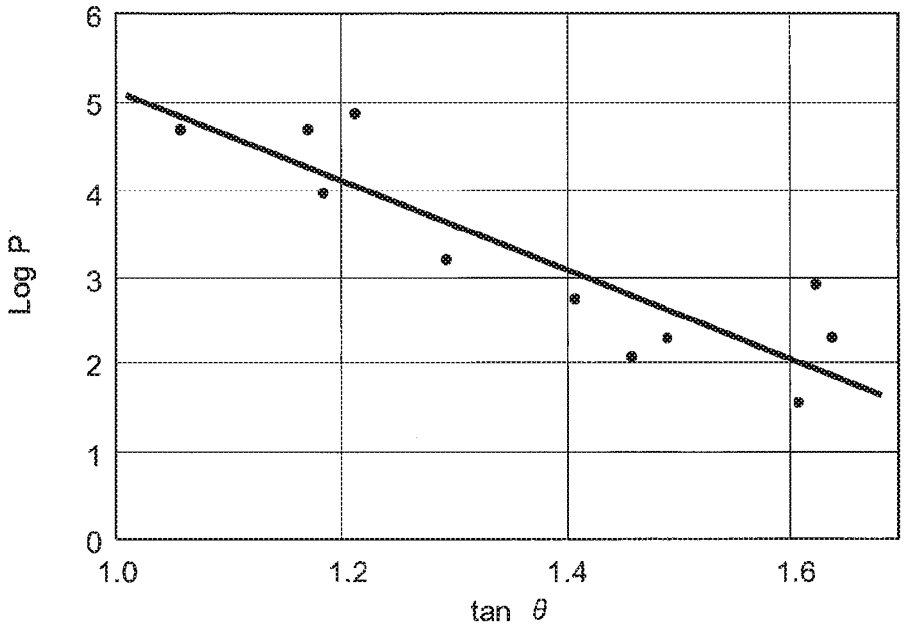
FIG. 9 shows the result of an investigation on the relationship between tan θ for angle θ in FIG. 8C and LogP.
Figure 10:
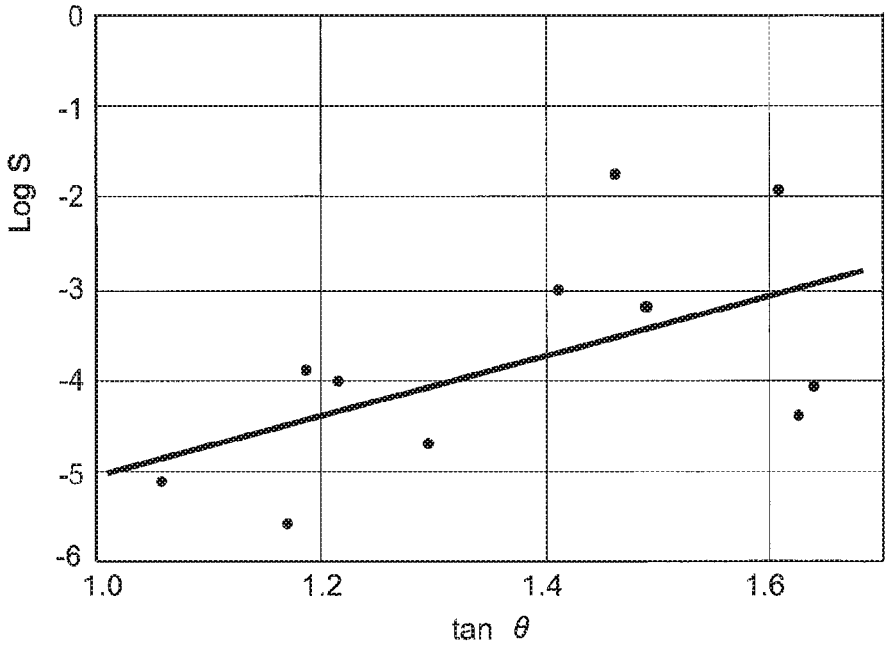
FIG. 10 shows the result of an investigation on the relationship between tan θ for angle θ in FIG. 8C and LogS.
Figure 11:
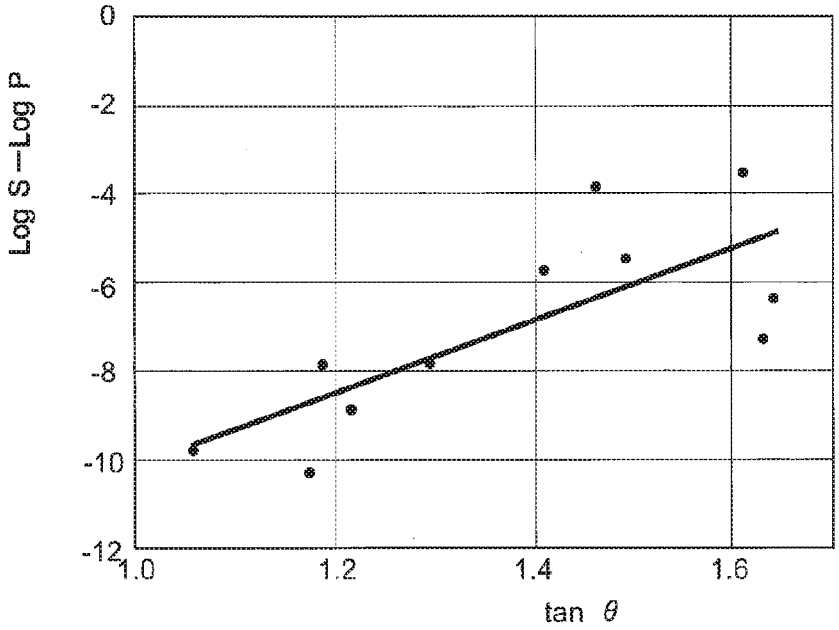
FIG. 11 shows the result of an investigation on the relationship between tan θ for angle θ in FIG. 8C and LogS-LogP.
Figure 12:
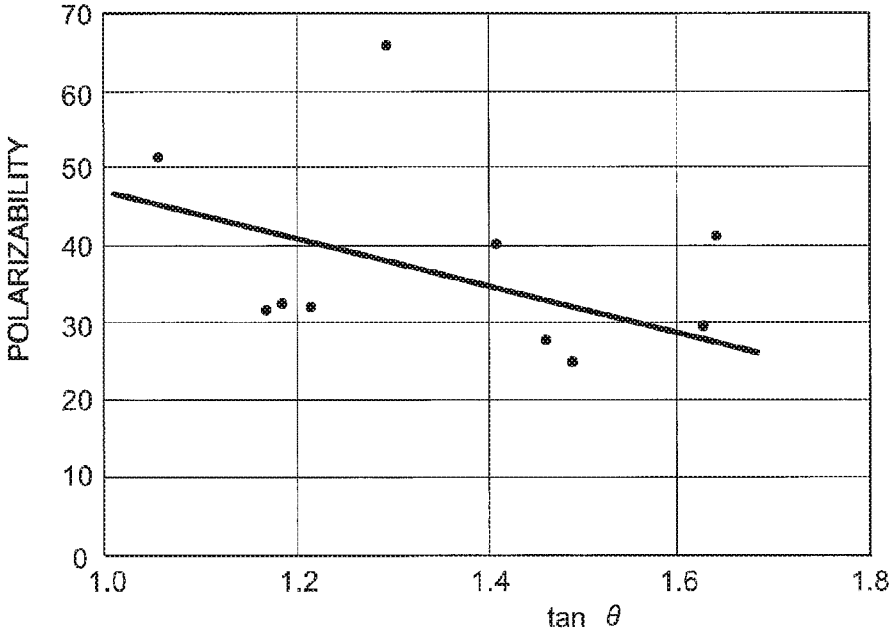
FIG. 12 shows the result of an investigation on the relationship between tan θ for angle θ in FIG. 8C and the polarizability.
Figure 13:
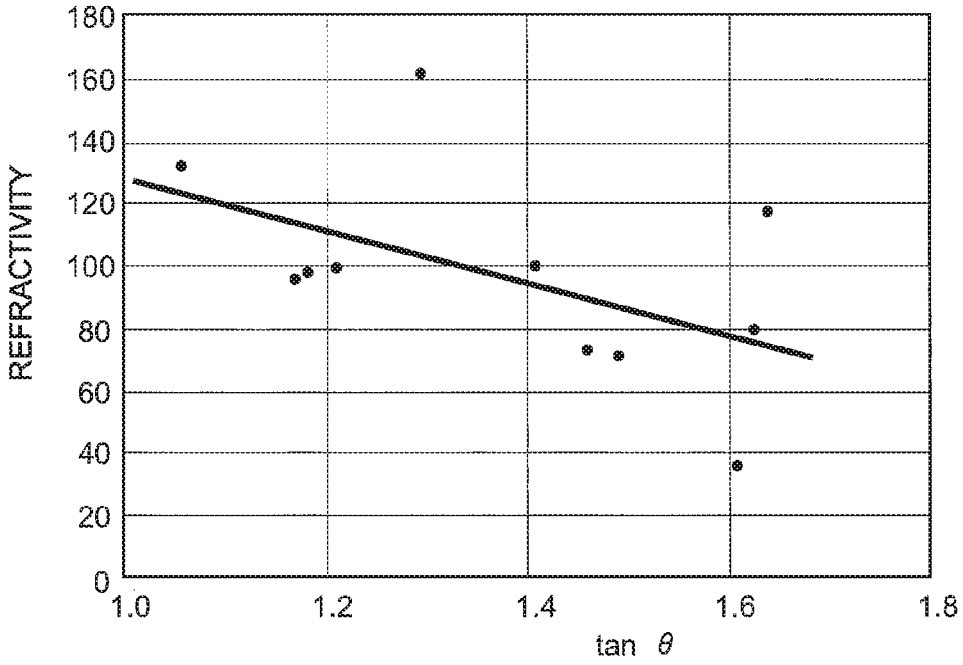
FIG. 13 shows the result of an investigation on the relationship between tan θ for angle θ in FIG. 8C and the refractivity.

FIGS. 8A-8C are graphs showing the signal intensity obtained by performing an MRM measurement for three different compounds D, E and F with the collision-gas pressure sequentially changed to multiple levels, using two apparatuses "a" and "b" which differ from each other in the structure of the electrodes contained in the collision cell 31, the diameter of the hole for introducing ions into the collision cell 31 and other structural aspects. What is noticeable in FIGS. 8A-8C is that the shape of the curve showing the relationship between the collision-gas pressure and the signal intensity for the same compound remains almost unchanged even if different apparatuses are used. This suggests that the shape of the curve showing the relationship between the collision-gas pressure and the signal intensity is not significantly dependent on the hardware (such as the structure of the electrodes within the collision cell 31), but can be considered to be mainly dependent on the nature of the compound to be analyzed.

Accordingly, in the present embodiment, the degree of increase in the signal intensity relative to an increase in the collision-gas pressure is used as an index for evaluating the shape of the curve showing the relationship between the signal intensity and the collision-gas pressure. For example, in the case of FIG. 8C, when the normalized collision-gas pressure is increased from 0.24 to 0.70, the normalized signal intensity increases from 0.24 to 1.00. Accordingly, the following equation (5) is used as the evaluation index:

$$\tan\theta = [\text{the increase } \beta \text{ in the normalized signal intensity}]/[\text{the increase } \alpha \text{ in the normalized collision-gas pressure}] \quad (5)$$

In the case of FIG. 8C, $\tan\theta=1.65$.

FIGS. 9-12 illustrate the relationships between $\tan\theta$ and the following indices of the compound: LogP, LogS, LogS-LogP, polarizability and refractivity, for a variety of compounds, with $\tan\theta$ calculated for each compound from the curve showing the relationship between the collision-gas pressure and the signal intensity. Those graphs demonstrate that each of the relationships between $\tan\theta$ and those indices (LogP, LogS, LogS-LogP, polarizability and refractivity) can be approximated by a straight line, and therefore, by a linear expression. That is to say, each of the approximate equations for calculating LogP, LogS, LogS-LogP, polarizability and refractivity can be formed as follows:

$$Z = e \cdot \tan\theta + f$$

where Z represents LogP, LogS, LogS-LogP, polarizability or refractivity, while e and f are constants.

As described earlier, those relationships are only dependent on the kind of compound. Accordingly, in the LC/MS/MS of the second embodiment, for example, the manufacturer of the apparatus determines the approximate equations for calculating LogP, LogS, LogS-LogP, polarizability and refractivity from $\tan\theta$ based on the results of MRM measurements performed on a number of compounds, and stores information representing those approximate equations in the compound-nature-index calculation information storage section 42 consisting of a non-volatile ROM or similar device.

When LogP or LogS of a known kind of target compound contained in a sample is to be obtained using the LC/MS/MS of the present embodiment, an analysis operator using the input unit 6 specifies the index to be obtained (e.g. LogP) and gives a command for initiating the measurement. Upon receiving this command, the compound-nature-index calculation process controller 53 operates the gas supplier 35 and the power source 36 so that the MRM measurement is repeatedly performed with the collision-gas pressure sequentially changed. In the present case, the liquid chromatograph unit 1 may be bypassed and the liquid sample containing the target compound can be directly introduced into the mass spectrometer 2 by the previously described flow injection method or infusion method.

Under the control of the compound-nature-index calculation process controller 53, the data processing unit 4 reads the detection signal obtained with the ion detector 34 for every change in the collision-gas pressure, whereby the data showing the relationship between the collision-gas pressure and the signal intensity are collected. Based on these data, the compound-nature-index calculator 41 determines the curve showing the relationship between the collision-gas pressure and the signal intensity, and calculates $\tan\theta$ from that curve. Then, it reads, from the compound-nature-index calculation information storage section 42, the approximate equation for calculating the specified index (e.g. LogP) and calculates the value of LogP (or other indice) from the calculated $\tan\theta$ based on this approximate equation. The result is displayed on the screen of the display unit 7 through the control unit 5. The values other than LogP can also be similarly calculated.

Alternatively, the LogP value may be calculated from a value of LogS-LogP of the target compound and a LogS value of the same compound, with the LogS value determined by the conventional method based on an actual measurement of the amount of dissolution of the compound in 100 g of water and the value of LogS-LogP calculated by the previously described method using the LC/MS/MS of the present embodiment. Similarly, the LogS value can be calculated using a value of LogP determined by the conventional method.

[Third Embodiment]

As shown in FIGS. 8A-8C, the shape of the curve showing the relationship between the collision-gas pressure and the signal intensity can be considered to be mainly dependent on the kind of compound. Therefore, if there is a database in which the kind of compound is linked with the information representing the shape of the curve showing the relationship between the collision-gas pressure and the signal intensity, it is possible to identify compounds using this database.

Figure 14:
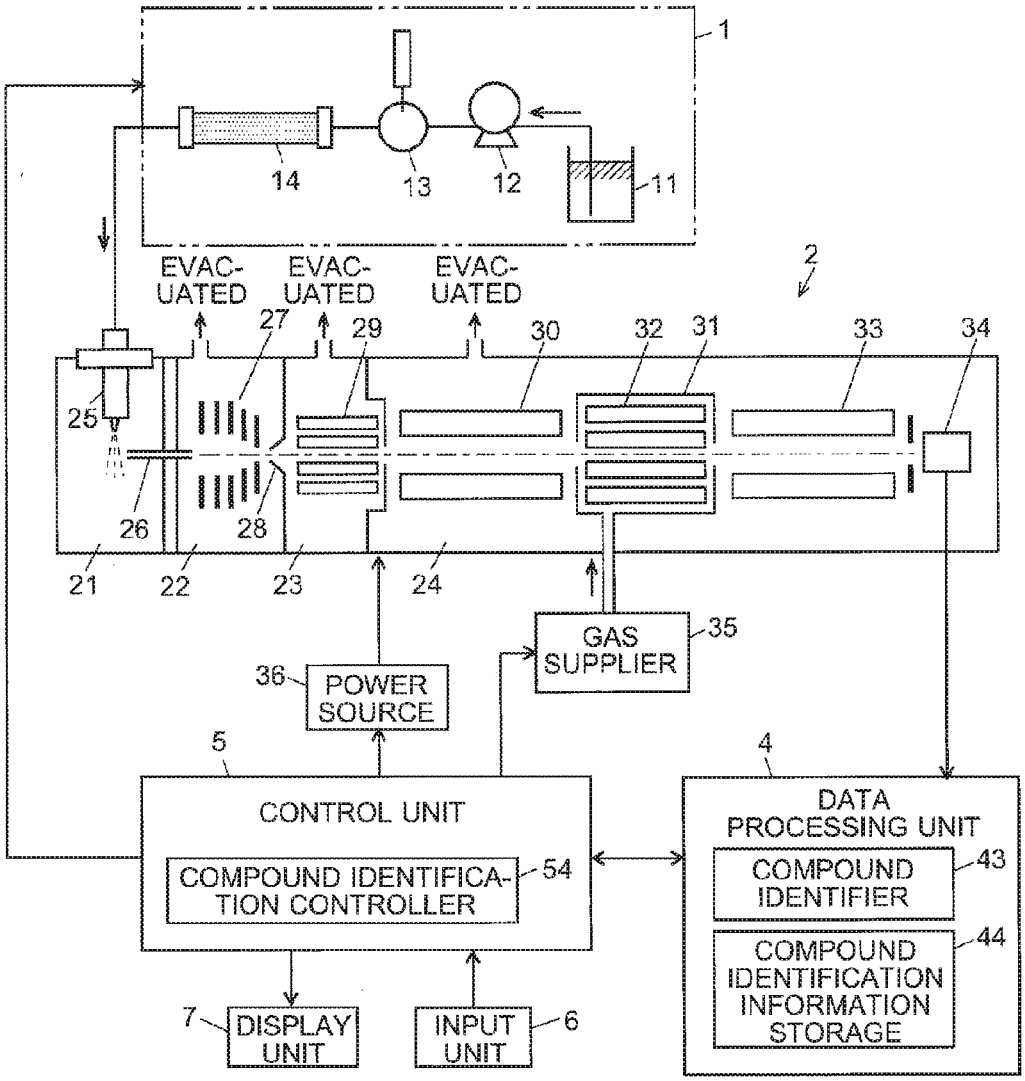
FIG. 14 is a schematic configuration diagram of the main components of the third embodiment of an LC/MS/MS using a triple quadrupole mass spectrometer according to the present invention.

The LC/MS/MS of the third embodiment has such a function. FIG. 14 is a schematic configuration diagram of the main components of the LC/MS/MS of this third embodiment. The configurations of the liquid chromatograph unit 1 and the mass spectrometer 2 are identical to those of the first embodiment, and therefore will not be described. In the LC/MS/MS of the third embodiment, the data processing unit 4 includes a compound identifier 43 and a compound identification information storage section 44 as its functional blocks, while the control unit 5 includes a compound identification controller 54 as its functional block. The compound identification information storage section 44 is the aforementioned database in which the kind of compound is linked with the information representing the shape of the curve showing the relationship between the collision-gas pressure and the signal intensity.

Similarly to the compound-nature-index calculation process controller 53 in LC/MS/MS of the second embodiment, the compound identification controller 54 operates the gas supplier 35 and the power source 36 so that the MRM measurement is repeatedly performed with the collision-gas pressure sequentially changed. Under the control of the compound identification controller 54, the data processing unit 4 reads the detection signal obtained with the ion detector 34 for every change in the collision-gas pressure, whereby the data showing the relationship between the collision-gas pressure and the signal intensity are collected. Based on these data, the compound identifier 43 determines the curve showing the relationship between the collision-gas pressure and the signal intensity, and compares the shape of this curve with the information stored in the compound identification information storage section 44 to extract the compound concerned or a compound having the highest degree of similarity. The result is displayed on the screen of the display unit 7 through the control unit 5. If the compound concerned has not been found, or if no compound having a degree of similarity equal to or higher than a predetermined level has been found, the compound can be concluded to be unidentifiable.

It should be noted that any of the previous embodiments is a mere example of the present invention, and any change, addition or modification appropriately made within the spirit of the present invention will naturally fall within the scope of claims of the present application.

REFERENCE SIGNS LIST

1 . . . Liquid Chromatograph Unit
11 . . . Mobile-Phase Container
12 . . . Liquid-Sending Pump
13 . . . Injector
14 . . . Column
2 . . . Mass Spectrometer
21 . . . Ionization Chamber
22, 23 . . . Intermediate Vacuum Chamber
24 . . . Analysis Chamber
25 . . . ESI Probe
26 . . . Heated Capillary
27, 29 . . . Ion Guide
28 . . . Skimmer
30 . . . Front Quadrupole Mass Filter
31 . . . Collision Cell
32 . . . Multipole Ion Guide
33 . . . Rear Quadrupole Mass Filter
34 . . . Ion Detector
35 . . . Gas Supplier
36 . . . Power Source
4 . . . Data Processing Unit
41 . . . Compound-Nature-Index Calculator
42 . . . Compound-Nature-Index Calculation Information Storage Section
43 . . . Compound Identifier
44 . . . Compound Identification Information Storage Section
5 . . . Control Unit
50 . . . Analysis Condition Setting Section
51 . . . Optimum Collision-Gas Pressure Calculator
52 . . . Optimum Collision-Gas Pressure Calculation Information Storage Section
53 . . . Compound-Nature-Index Calculation Process Controller
54 . . . Compound Identification Controller
6 . . . Input Unit
7 . . . Display Unit

The invention claimed is:

1. A triple quadrupole mass spectrometer having: a front quadrupole mass filter for selecting, as a precursor ion, an ion having a specific mass-to-charge ratio from among various ions; a collision cell for dissociating the precursor ion by making this ion collide with a predetermined collision gas; a rear quadrupole mass filter for selecting an ion having a specific mass-to-charge ratio from among various product ions produced by the dissociation; and a detector for detecting the selected product ion, the triple quadrupole mass spectrometer comprising:

a) a prior information storage section in which information showing a relationship between an optimum collision-gas pressure giving a highest or nearly highest level of detection sensitivity and at least one parameter is previously stored, the one parameter selected from a group consisting of a mass-to-charge ratio of the precursor ion, a mass-to-charge ratio of the product ion, a sum of the mass-to-charge ratio of the precursor ion and the mass-to-charge ratio of the product ion, as well as a collision energy; and b) an optimum gas pressure calculator for calculating, based on the information stored in the prior information storage section, the optimum collision-gas pressure corresponding to a measurement condition when at least one of following parameters is set as the measurement condition: the mass-to-charge ratio of the precursor ion originating from a compound to be analyzed, the mass-to-charge ratio of the product ion, and the collision energy in a measurement.

2. The triple quadrupole mass spectrometer according to claim 1, wherein:

two or more kinds of information each of which shows a relationship between the optimum collision-gas pressure and one of two or more parameters are previously stored in the prior information storage section, the two or more parameters selected from the group consisting of the mass-to-charge ratio of the precursor ion, the mass-to-charge ratio of the product ion, the sum of the mass-to-charge ratio of the precursor ion and the mass-to-charge ratio of the product ion, as well as the collision energy; and the optimum gas pressure calculator calculates, using a combination of the two or more kinds of information stored in the prior information storage section, the optimum collision-gas pressure corresponding to the measurement condition when at least two parameters selected from a group consisting of the mass-to-charge ratio of the precursor ion corresponding to the compound to be analyzed, the mass-to-charge ratio of the product ion, and the collision energy are set as the measurement condition.

3. The triple quadrupole mass spectrometer according to claim 1, wherein:

the information previously stored in the prior information storage section includes a first set of information showing a relationship between the optimum collision-gas pressure and at least one parameter selected from a group consisting of the mass-to-charge ratio of the precursor ion, the mass-to-charge ratio of the product ion, as well as the sum of the mass-to-charge ratio of the precursor ion and the mass-to-charge ratio of the product ion, and a second set of information showing a relationship between the collision energy and the optimum collision-gas pressure; and the optimum gas pressure calculator initially calculates the optimum collision-gas pressure corresponding to the measurement condition, based on the first set of information stored in the prior information storage section, when the mass-to-charge ratio of the precursor ion to be analyzed and/or the mass-to-charge ratio of the product ion is set in the measurement condition, and subsequently calculates the collision energy corresponding to the calculated optimum collision-gas pressure, based on the second set of information stored in the prior information storage section.

4. A triple quadrupole mass spectrometer having: a front quadrupole mass filter for selecting, as a precursor ion, an ion having a specific mass-to-charge ratio from among various ions; a collision cell for dissociating the precursor ion by making this ion collide with a predetermined collision gas; a rear quadrupole mass filter for selecting an ion having a specific mass-to-charge ratio from among various product ions produced by the dissociation; and a detector for detecting the selected product ion, the triple quadrupole mass spectrometer comprising:

a) an analysis controller for controlling each section of the mass spectrometer so as to perform a multiple reaction monitoring measurement on a target compound while continuously or discontinuously varying a collision-gas pressure within the collision cell;

b) a data processor for obtaining a relationship between a change in a collision-gas pressure and a change in a signal intensity, based on a detection signal obtained under a control by the analysis controller; and c) a compound information estimator for determining a parameter indicating a physical or chemical nature of the target compound, based on a shape of a curve showing the relationship between the change in the pressure of the collision gas and the change in the signal intensity.

5. The triple quadrupole mass spectrometer according to claim 4, wherein:

the compound information estimator determines LogP, LogS, LogS-LogP, polarizability or refractivity of the target compound.

6. A triple quadrupole mass spectrometer having: a front quadrupole mass filter for selecting, as a precursor ion, an ion having a specific mass-to-charge ratio from among various ions; a collision cell for dissociating the precursor ion by making this ion collide with a predetermined collision gas; a rear quadrupole mass filter for selecting an ion having a specific mass-to-charge ratio from among various product ions produced by the dissociation; and a detector for detecting the selected product ion, the triple quadrupole mass spectrometer comprising:

a) an analysis controller for controlling each section of the mass spectrometer so as to perform a multiple reaction monitoring measurement on a target compound while continuously or discontinuously varying the collision-gas pressure within the collision cell;

b) a data processor for obtaining a relationship between a change in the collision-gas pressure and a change in a signal intensity, based on a detection signal obtained under a control by the analysis controller;

c) a qualitative information storage section in which a shape of a curve showing the relationship between the change in the collision-gas pressure and the change in the signal intensity is stored in relation to a kind of compound; and d) a compound identifier for identifying the target compound by comparing a shape of a curve obtained by the data processor with the information stored in the qualitative information storage section.

* * * * *